US006368260B1

(12) United States Patent
Crews

(10) Patent No.: US 6,368,260 B1
(45) Date of Patent: Apr. 9, 2002

(54) REHABILITATION CHAIR

(76) Inventor: Stanley Crews, 21524 Webbwood Ave., Port Charlotte, FL (US) 33954

( * ) Notice: Subject to any disclaimer, the term of this patent is extended or adjusted under 35 U.S.C. 154(b) by 0 days.

(21) Appl. No.: 09/556,994

(22) Filed: Apr. 24, 2000

Related U.S. Application Data

(60) Provisional application No. 60/146,788, filed on Aug. 2, 1999.

(51) Int. Cl.[7] ..... A63B 21/00; A63B 22/08

(52) U.S. Cl. ..... 482/142; 482/62; 482/130; 482/134; 482/904

(58) Field of Search ..... 482/57, 62, 123, 482/129, 130, 133, 134, 142, 904; 280/304.1; 297/148–155

(56) References Cited

U.S. PATENT DOCUMENTS

| | | | | | |
|---|---|---|---|---|---|
| 3,738,649 | A | * | 6/1973 | Miller | 482/57 |
| 4,165,127 | A | * | 8/1979 | Vago | 297/344.18 |
| 4,913,423 | A | * | 4/1990 | Farran et al. | 482/130 |
| 4,921,247 | A | * | 5/1990 | Sterling | 482/138 |
| 5,141,482 | A | * | 8/1992 | Hern | 482/130 |
| 5,171,295 | A | * | 12/1992 | Schwalm | 482/131 |
| 5,234,394 | A | * | 8/1993 | Wilkinson | 482/92 |
| 5,470,298 | A | * | 11/1995 | Curtis | 482/130 |
| 5,496,236 | A | * | 3/1996 | Buonauito | 482/57 |
| 5,690,594 | A | * | 11/1997 | Mankovitz | 482/121 |
| 5,743,838 | A | * | 4/1998 | Willis | 482/124 |
| 6,013,014 | A | * | 1/2000 | Hern | 482/121 |
| 6,063,012 | A | * | 5/2000 | Berkowitz | 482/121 |
| 6,117,056 | A | * | 9/2000 | Cataldi et al. | 482/121 |

FOREIGN PATENT DOCUMENTS

| | | | |
|---|---|---|---|
| WO | 84/04690 | * 12/1984 | 482/130 |

* cited by examiner

*Primary Examiner*—Mickey Yu
*Assistant Examiner*—Victor Hwang
(74) *Attorney, Agent, or Firm*—Frank A. Lukasik

(57) ABSTRACT

An exercise system for persons with physical disabilities consisting of an upholstered chair having a table top mounted on the two arms, a support step having a pedal assembly mounted in a slots, a "T" support inserted into the table top mounting bracket, elastic straps affixed to the back of the chair, and a plurality of exercisers attached to the chair.

5 Claims, 5 Drawing Sheets

REHABILITATION CHAIR

RELATED INVENTION

This application claims the benefit of Provisional Application Serial No. 60/146,788, filed Aug. 2, 1999.

BACKGROUND OF THE INVENTION

1. Field of the Invention

The present invention relates generally to exercise equipment and more specifically to an exercise chair for persons with physical disabilities, and particularly for stroke victims.

2. Discussion of the Prior Art

The prior art exercise devices for the disabled are generally designed either to facilitate their transition from a standing position or vice versa, or as recliners, massagers, or heaters. Other rehabilitation equipment is available in various centers but not readily available at a persons home. There are no combinations of exercise equipment which are specifically designed for stroke victims.

SUMMARY OF THE INVENTION

The broad purpose of the invention is to provide an exercise chair specifically designed for persons with physical disabilities so the quality of life of such persons can be improved by accommodating their disabilities in such a manner that they may enjoy some of the pursuits enjoyed by the able-bodied. More specifically, the invention is an upholstered arm chair constructed to allow a person to exercise their upper and lower body while seated comfortably. The methods of exercise include among others, pedaling a stationary set, stretching against elastic resistance devices and squeezing pliable objects.

The present invention is a chair in the normal sense, which is modified to permit a seated person to pedal the pedal set while seated. The seat cushion of the chair is modified to resemble a bicycle seat with a protruding front support or horn which permits the users' upper legs to reciprocate freely without interference from the seat cushion as the person pedals. It is a well established medical fact that the exercising of the larger muscles in the lower limbs for a sustained period, can elevate the metabolic rate and thereby produce the benefits of an aerobic exercise program. In the case of persons who may have sustained or have been treated for cardiac malfunction, the pedals may be relocated to a positioned such that the person may pedal using the upper limbs and thereby exercise the chest area. The chair can be fitted with a variety of attachment points whereby elastic resistance devices may be anchored to permit the user to alternately stretch and release the elastic devices thereby exercising and strengthening muscles in very specific ways according to the directions of the qualified medical personnel in charge of the person's rehabilitation. The invention includes a large table surface which rests upon the upper edges of the arms of the chair. The table serves the various functions of providing a surface from which, apart from supporting a "T" handle to hold while pedaling, a person and their partner may share a meal, play cards or games or otherwise include each other in shared activities.

DESCRIPTION OF A PREFERRED EMBODIMENT

Figure 1:
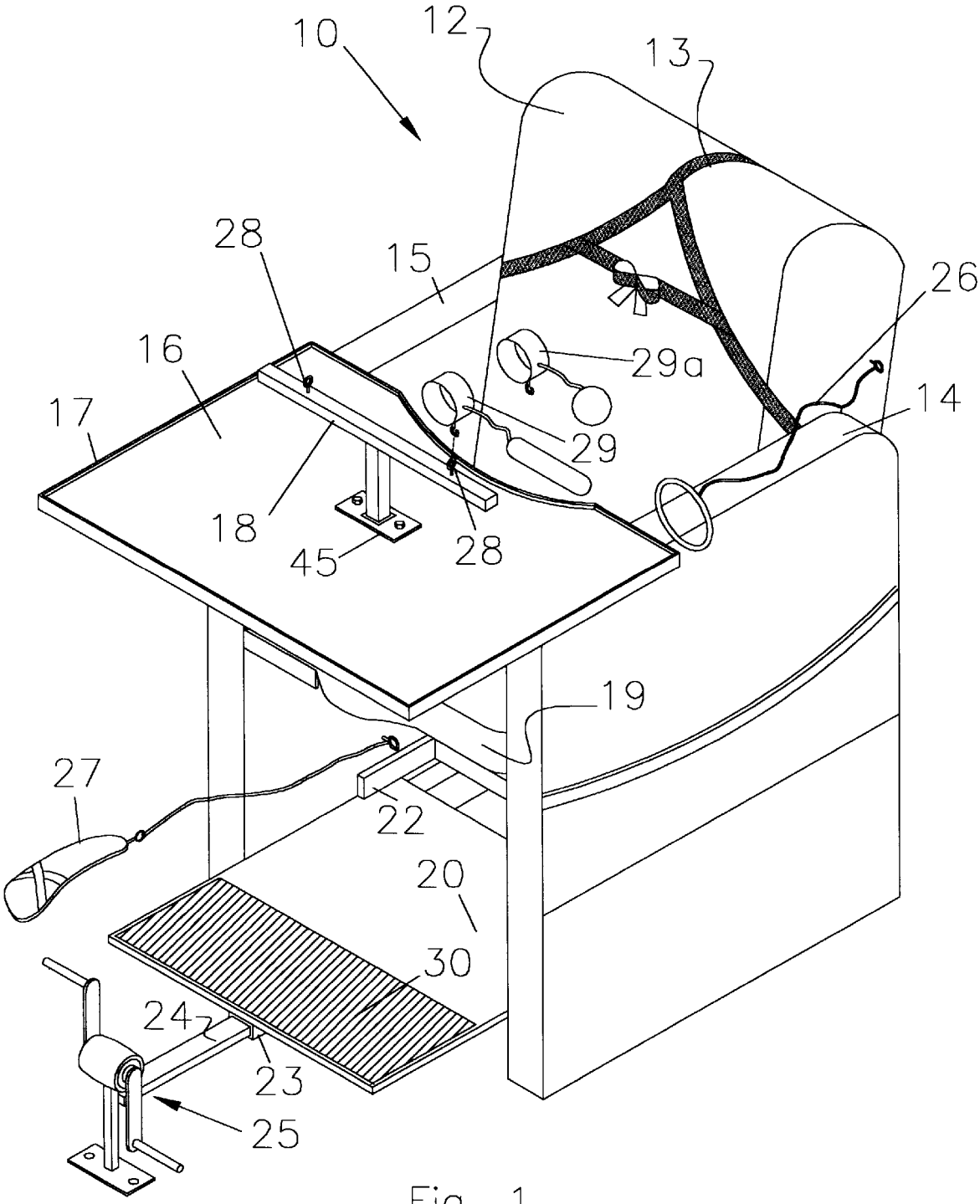
FIG. 1 is a perspective view of the chair in its fully configured state.

Referring now to the drawings wherein like numerals designate like and corresponding parts throughout the several views, in FIG. 1 the overall invention is designated by the numeral 10, chair back 11 supports back cushion 12 in between arms 14 and 15. Elastic support straps 13 are anchored to chair back 11. Seat cushion 19 is visible in its location beneath table top 16 which rests upon arms 14 and 15. Lip 17 provides a safety perimeter to prevent objects from rolling off the table top 16 to the floor. The dimensions of the lip 17 are such that it provides a small barrier as described, and yet does not prevent the comfortable use of the table top 16 surface by the user and or a companion. "T" support 18 is removably located in a mounting bracket 45 in a position which enables the user to support the upper limbs while pedaling with the lower limbs. The upper support 18 may be replaced by pedal assembly 25 for use as an upper body exerciser.

Support step 20 is contained between rails 21 and 22. Slot 23 provides a guide for pedal assembly support arm 24 by which pedal assembly 25 is slidably attached to step 20. Foot rest 43 can be mounted on one or both pedals of pedal assembly 25 to assist the user whose disabilities make it difficult to maintain contact with the pedal without some restraint. Straps 44 will secure the users foot in place. Non-slip surface 30 provides a safety feature to step 20. Elastic exerciser 26 is attached to chair back 12. Hand exercisers 29*a* and 29 can be removably attached to "T" bar 18 by hooks into eyes 28. This enables users who may have difficulty in gripping the exercisers 29*a* and 29 to retain them in the event they lose their grip. Leg exerciser 27 is attached to chair frame rail 22 (on either or both sides) by a flexible elastic band against which the user pulls. A user's foot is secured by straps over the foot piece.

Figure 2:
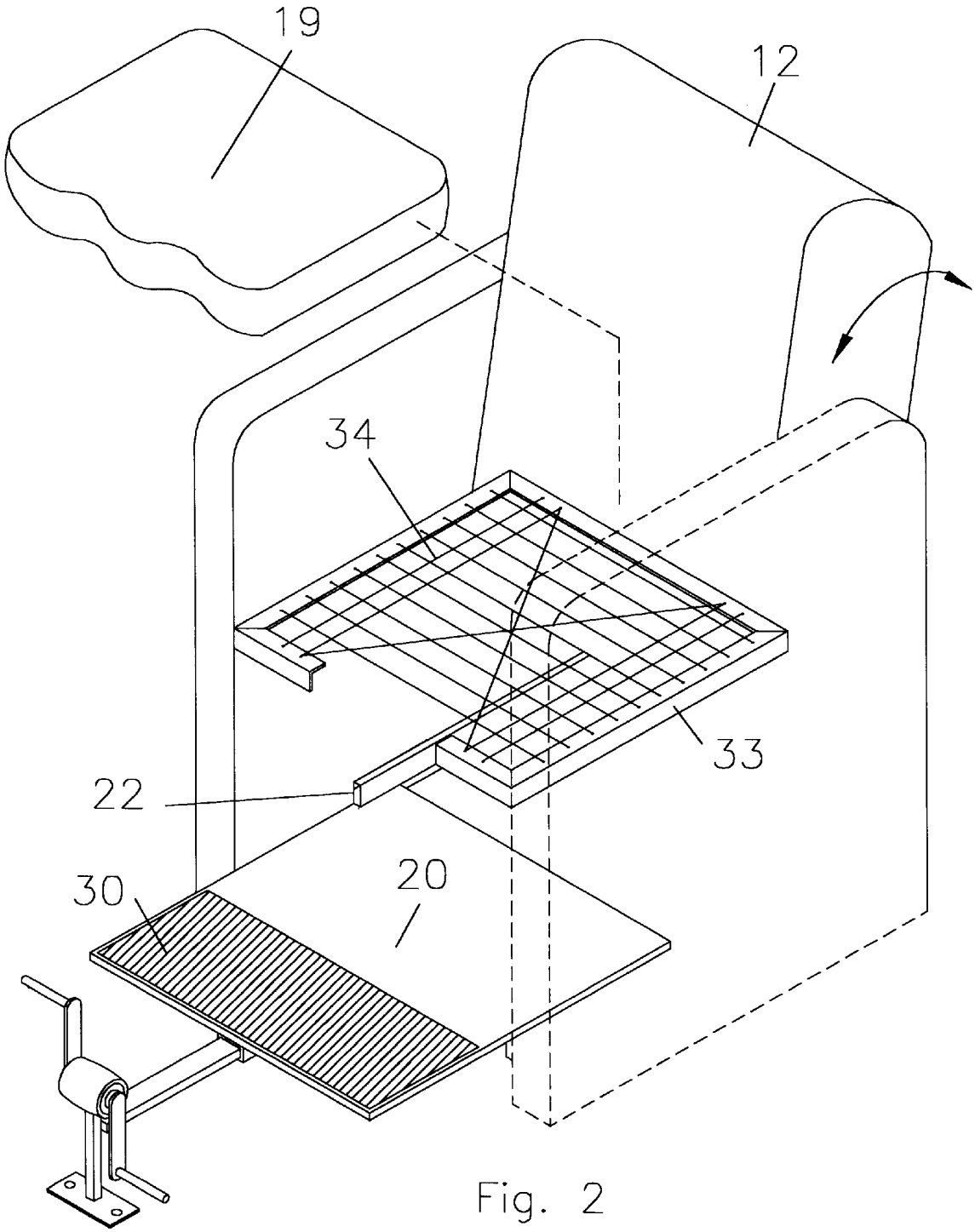
FIG. 2 is a perspective view, partially in section of the chair showing some of its major internal components.

In FIG. 2, metal frame 33, constructed typically of mild steel angle approximately 1.5 inches high and approximately 25 inches wide holds retaining wires 34 in any arrangement which prevents cushion 19 from folding and collapsing under the weight of a user.

Figure 3:
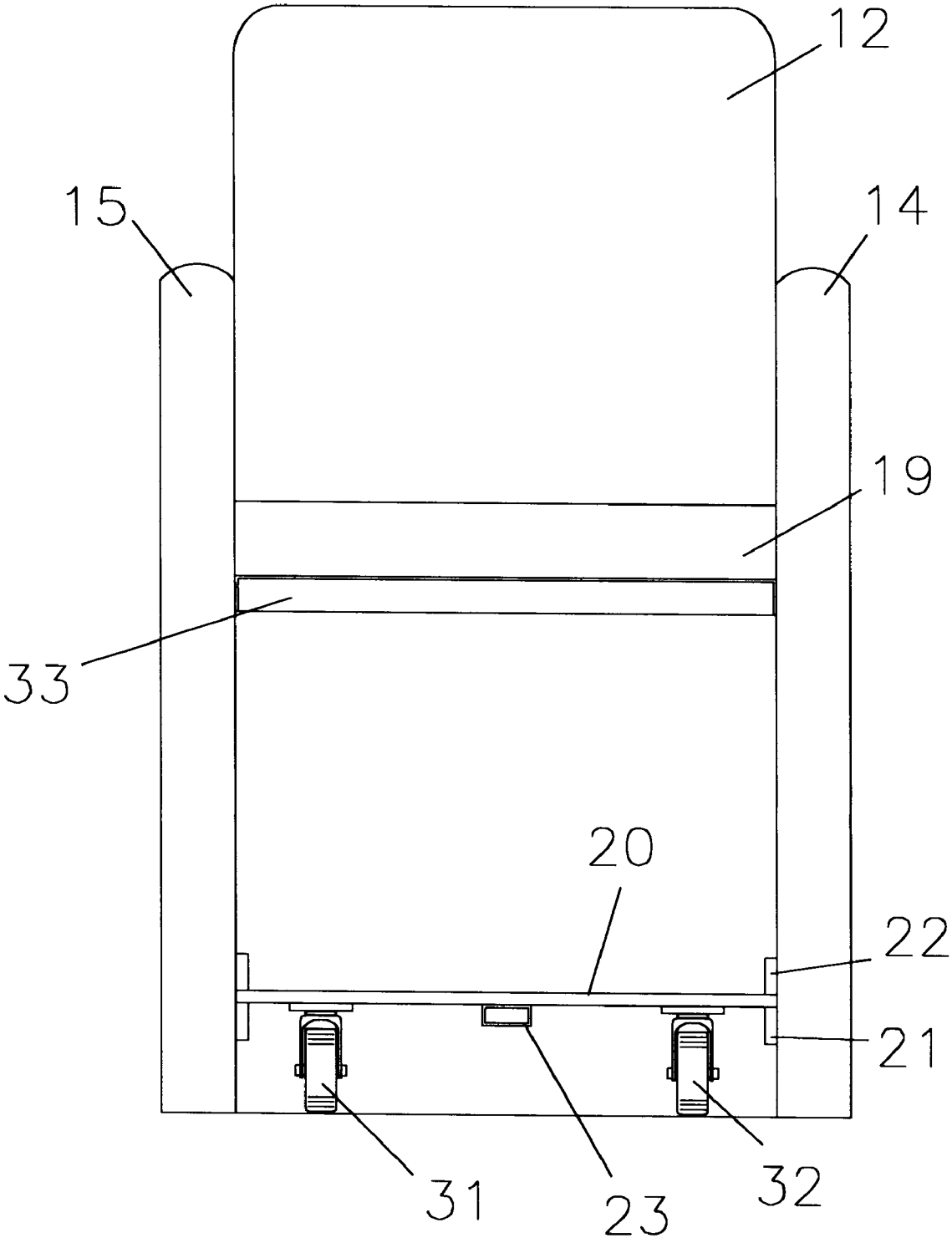
FIG. 3 is a front view of the chair with some components absent for clarity.

In front view FIG. 3, the relative portion of each component listed is shown in addition to which are shown casters 31 and 32 which facilitate the easy deployment of step 20 while simultaneously providing stability for the entire chair 10 as the user stands upon step 20.

Figure 4:
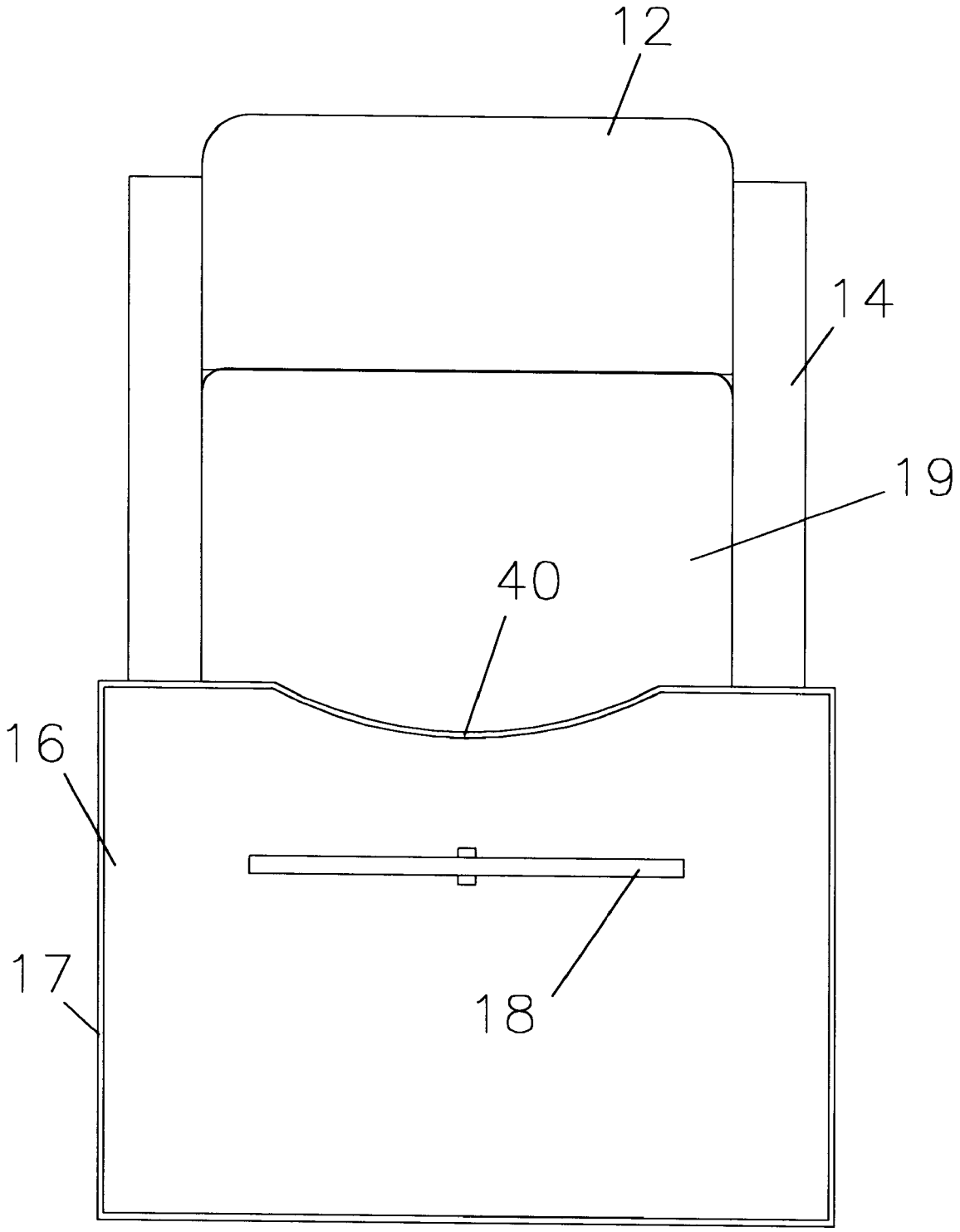
FIG. 4 is a top view of the chair showing the table top in position.
Figure 5:
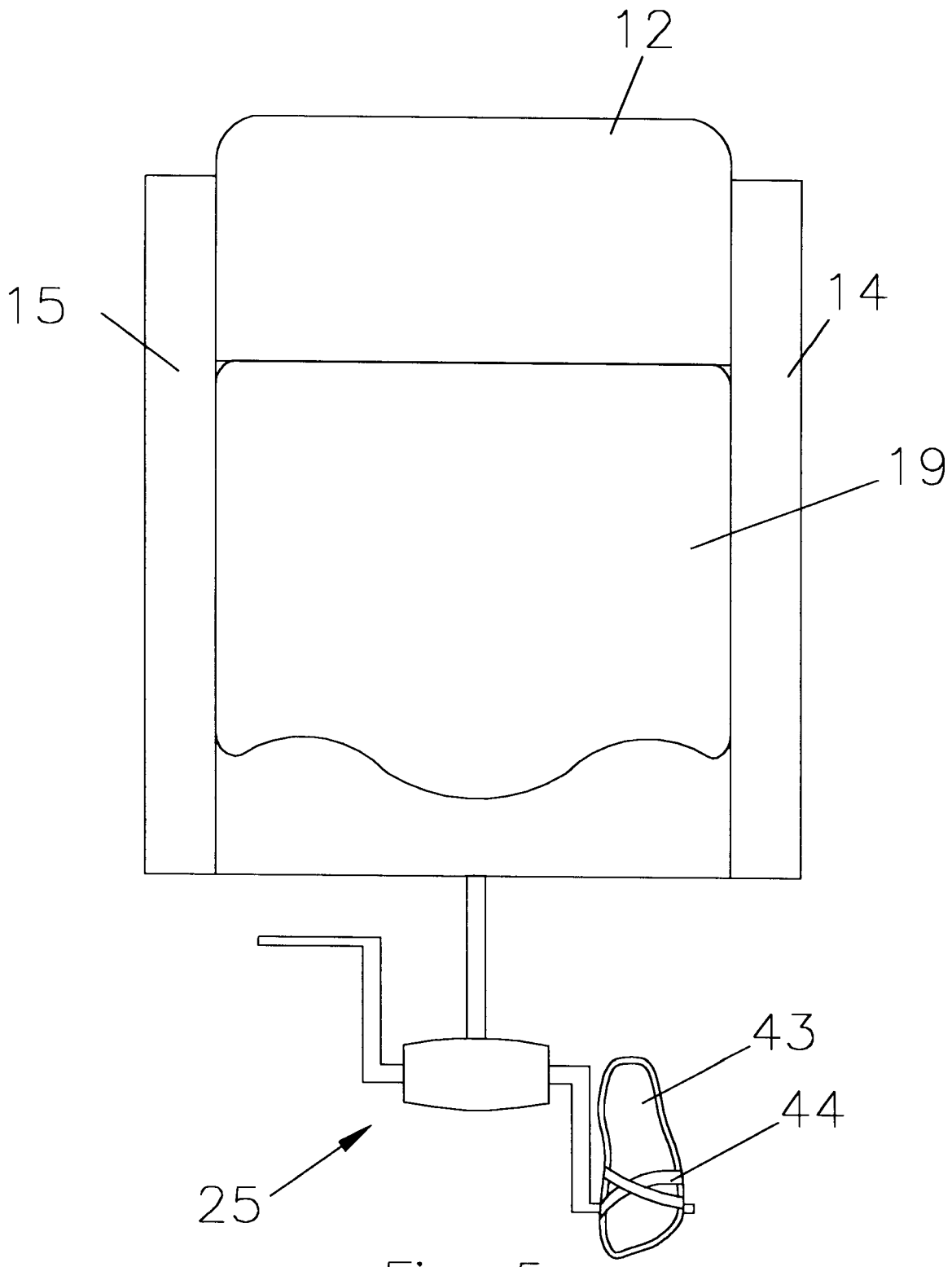
FIG. 5 is a top view with the table top removed for clarity.

In top view FIG. 4, indent 40 provides a measure of comfort for the user to nestle table top 16 against the abdomen. In top view FIG. 5, cushion 12 is shown in its position relative to arms 14 and 15.

Of course, it should be understood that a wide range of changes and modifications can be made in the preferred embodiment described above. It is therefore, intended that the foregoing descriptions be regarded as illustrative rather than limiting and that it can be understood that it is the following claims, including all equivalents, which are intended to define the scope of the invention.

What is claimed is:

1. An exercise system for persons with physical disabilities, said system comprising:

at least one exerciser;

a chair having a back, two arms, a metal seat frame, a seat cushion, two support rails, a support step contained between said support rails, said support step having a top surface and a bottom surface, a slot affixed to said support step bottom surface for selectively securing one of said at least one exercise;

a pair of casters affixed to said support step bottom surface, a non-slip surface affixed to said support step top surface, elastic support straps affixed to said back, and a table top having a top surface and a first and second end, said table top being removably attached across said two arms, said table top having an indent formed at a first end, a lip affixed around the periphery of said top surface, and a mounting bracket affixed to said table top surface for selectively securing one of said at least one exerciser.

2. An exercise system for persons with physical disabilities of claim 1 wherein said at least one exerciser comprises a pedal assembly having a support arm is removably inserted in said slot affixed to said support step bottom.

3. An exercise system for persons with physical disabilities of claim 1 wherein a "T" support is inserted into said table top mounting bracket.

4. An exercise system for persons with physical disabilities of claim wherein said at least one exerciser comprises a plurality of hand exercisers are attached to said chair, a first exerciser being attached to said back, a second exerciser being attached to said support step, and a third exerciser being attached to said "T" support.

5. An exercise system for persons with physical disabilities, said system consisting of:

an upholstered chair having a back, two arms, a metal seat frame, a seat cushion, two support rails, a support step contained between said support rails, said support step having a top surface and a bottom surface, a slot affixed to said support step bottom surface, a pair of casters affixed to said support step bottom surface, a non-slip surface affixed to said support step top surface, elastic straps affixed to said back, a table top having a top surface and a first and second end, said table being removably attached across said two arms, said table top having an indent formed at a first end, a lip affixed around the periphery of said top surface, and a mounting bracket affixed to said table top surface, a pedal assembly having a support arm removably inserted in said slot affixed to said support step bottom, a "T" support inserted into said table top mounting bracket, a first exerciser being attached to said back, a second exerciser being attached to said support step, and a third exerciser being attached to said "T" support.

* * * * *